United States Patent [19]

Newton et al.

[11] 4,344,558

[45] Aug. 17, 1982

[54] PINCH BOTTOM VALVE BAG

[75] Inventors: Donald O. Newton, Pensacola; Fred B. Wilharm, Cantonment, both of Fla.

[73] Assignee: St. Regis Paper Company, New York, N.Y.

[21] Appl. No.: 166,171

[22] Filed: Jul. 7, 1980

[51] Int. Cl.[3] ..... B65D 30/24

[52] U.S. Cl. ..... 229/62.5

[58] Field of Search ..... 229/62.5; 150/9

[56] References Cited

U.S. PATENT DOCUMENTS

| | | | |
|---|---|---|---|
| 2,437,693 | 3/1948 | Hartman | 229/62.5 |
| 2,635,803 | 4/1953 | Hartman | 229/62.5 |
| 2,811,300 | 10/1957 | Landell | 229/62.5 |
| 3,018,943 | 1/1962 | Keating | 229/62.5 |
| 3,203,623 | 8/1965 | Hartig | 229/62.5 |
| 3,472,130 | 10/1969 | Brockmuller | 229/62.5 |
| 4,069,964 | 1/1978 | Willet et al. | 229/62.5 |

FOREIGN PATENT DOCUMENTS

| | | | |
|---|---|---|---|
| 714142 | 8/1954 | United Kingdom | 229/62.5 |
| 625519 | 6/1949 | United Kingdom | 229/62.5 |

*Primary Examiner*—Stephen P. Garbe

*Attorney, Agent, or Firm*—Joseph M. Maguire

[57] ABSTRACT

A multi-ply, gusseted, stepped end, pinch bottom bag is disclosed which includes a sleeved valve in a corner of one end for receiving a filling spout from a product dispensing machine. The valve is completely sift-proof and is constructed without making changes in the cut shape and relationship of the various plies of the bag to accommodate the valve sleeve. The bag is made from a plurality of plies of flexible material, such as kraft paper, which are cut and scored to permit a multiwall, gusseted, stepped end, pinch bottom bag to be formed and to further permit a valve area to be formed at one corner when the front wall, rear wall and gusset panels in that region are infolded. The valve sleeve which is inserted into the valve area includes a tuck-in flap which is sized and shaped to correspond to the pocket formed when the wall and gusset panels are folded back against the inside walls of the bag. When the bag is being assembled, the tuck-in flap is inserted into the pocket, aligned with the fold lines defining the bottom and side edges of the pocket and secured therein by a suitable adhesive.

4 Claims, 10 Drawing Figures

Fig. 1.
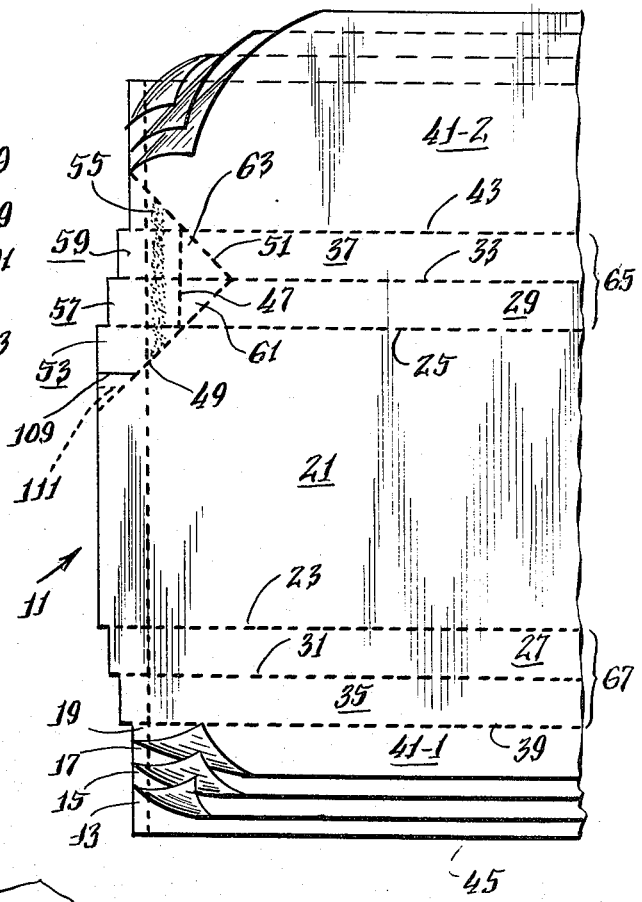
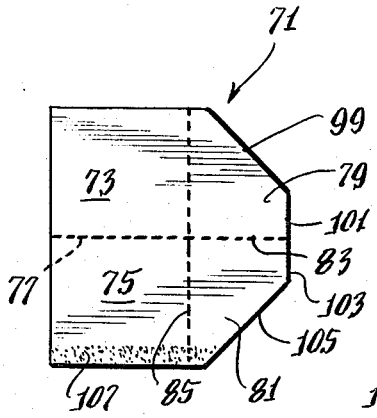
Fig. 2.
Fig. 3.
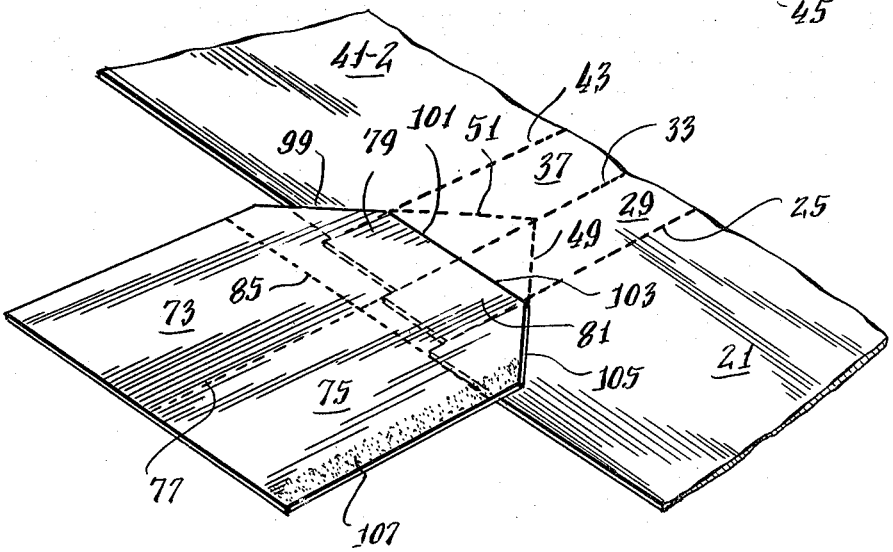

PINCH BOTTOM VALVE BAG

The present invention relates generally to multi-ply, gusseted, stepped end, pinch bottom bags and more particularly to a multi-ply, gusseted, stepped end pinch bottom bag which includes a sleeved valve in a corner of one end for receiving a filling spout of a product dispensing machine.

Multi-ply, gusseted, stepped end, pinch bottom bags are well known to those skilled in the art and are often referred to in the industry as pinch style bags or pinch bottom bags because of their unique end closure. Such bags are usually formed of a plurality of contiguous plies of flexible sheet material arranged to provide a front wall and an oppositely disposed rear wall which is adapted to overlap the front wall when the bag is in its assembled condition. The bag is longitudinally and reversely creased along diametrically opposed portions in order to provide a pair of oppositely disposed gussets which are interposed between front and rear surfaces. Each gusset has a front portion and a stepped rear portion which is adapted to overlap the front portion within the overlap area of the front and rear walls at the end of the bag in its assembled condition.

Pinch style bags are well suited for packaging most materials, and in particular, are useful for packaging granular, free flowing products, products requiring a high degree of moisture protection and food grade products that require protection from infestation of the packaged product. The stepped end configuration permits the formation of strong end closures. At the same time, the overall strength of the bag results from the arrangement of the terminal edges of the different walls and gussets which form the tubular body of the bag.

An example of a pinch style bag may be found in U.S. Pat. No. 3,776,451 to J. J. Goodrich et al, which patent is incorporated herein by reference.

Pinch style bags which include a sleeve valve at a corner of one end for receiving a filling spout of a product dispensing machine are also known in the art. Such bags are particularly useful in that they do not require special filling equipment to fill the bag with products and do not require that the bag user have his own sealing equipment as is the case with conventional or open mouth style pinch bottom bags.

An example of a sleeved valve, pinch bottom bag may be found in U.S. Pat. No. 4,069,964 to G. L. Willet et al.

In the past, pinch style bags having a sleeved valve at one corner have been constructed by taking a blank used to make a conventional pinch style bag and forming thereon additional cut and score lines to permit a valve area to be formed at one end when the gussets in that region are infolded. The sleeve is formed from a rectangularly shaped blank, such as is used in forming a valve sleeve in a pasted end or sewn type bag. In order to accommodate the sleeving operation, at least one of the plies of the bag blank is shaped to include a valve notch or strip at its uper edge. During the assembly of the bag, the sleeve blank is secured to the valve notch by adhesive or other suitable means.

One of the shortcomings with this technique for incorporating a sleeved valve into a pinch style bag is that the valve so formed is not completely siftproof. Specifically, it has been found that the products, especially fine powdery products, will have a tendency to leak through the bag in the area where the sleeve is attached to the valve notch. Another shortcoming with this technique for incorporating a sleeved valve into a pinch style bag is that adding material to the top of the bag blank to produce the notch strip for accommodating the valve sleeve results in a corresponding loss of material from the bottom of the next consecutive bag blank when the bag blanks are machine cut one after another from a plurality of continuous webs of paper. This loss of material produces a structural weakness in the bottom of the next bag. In order to overcome this structural weakness, it has been found necessary to add a reinforcing strip to the bottom of the bags. This, of course, results in additional cost for the materials and an additional step in assembling the bag.

Thus, it is apparent that a need exists for a new and improved technique for constructing a pinch style bag having a sleeved valve in a corner of one end.

It is an object of this invention to provide a new and improved pinch style bag.

It is another object of this invention to provide a new and improved multi-ply gusseted, stepped end, pinch bottom bag of the type which includes a sleeved valve at one corner thereof for use in receiving a filling spout of a product dispensing machine.

It is another object of this invention to provide a pinch bottom valve bag which is completely siftproof.

It is yet another object of this invention to provide a pinch bottom sleeved valve bag which is made from a conventional pinch bottom style bag blank.

It is another object of this invention to provide a pinch bottom sleeved valve bag which can be mass produced and wherein the bag blanks can be cut from a plurality of continuous webs of paper without wasting the paper of any web.

It is still another object of this invention to provide a new and improved valve sleeve for use in a pinch bottom sleeved valve bag.

It is yet another object of this invention to provide a pinch style sleeved valve bag which does not require a valve notch in the bag blank to accommodate the valve sleeve.

It is another object of this invention to provide a new and improved technique for inserting, locating and for attaching a valve sleeve to a valve area in a pinch bottom bag.

A multi-ply, gusseted, stepped end, pinch bottom, sleeved valve bag constructed according to the teachings of this invention is formed from two blanks. One of the blanks is utilized to form the bag itself and the other blank is utilized to form the sleeve which is attached to the valve portion of the bag. The blank used to form the bag comprises a plurality of contiguous plies of flexible sheet material which are cut and scored to permit a valve area to be formed at one corner of the bag when the gussets and front and rear walls in that region are infolded against the inside walls of the bag. The blank used to form the valve sleeve includes a tuck-in flap sized and shaped to correspond to the shape of the pocket formed by the infolded wall and gusset portions. When the bag is being assembled, the tuck-in flap is inserted into the pocket, aligned with the fold lines defining the bottom and side edges of the pocket and secured in place therein by a suitable adhesive.

One of the advantages of the bag is that the valve so formed is completely siftproof. Another advantage of the bag is that it is constructed without making any changes in the cut shape of the bag blank in order to accommodate the sleeve material.

The above and other objects, features and advantages will appear from the description to follow. In the description, reference is made to the accompanying drawings which form a part thereof, and in which is shown by way of illustration a specific embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the invention is best defined by the appended claims.

In order that the invention may be more fully understood, it will now be described by way of example with reference to the drawings wherein like reference numerals represent like parts and wherein:

FIG. 1 is a plan view of a portion of the blank for forming the bag of the present invention;

FIG. 2 is a plan view of the blank for forming the sleeve for use with the blank shown in FIG. 1;

FIGS. 3–7 are a series of views showing the sleeving sequence for forming the sleeved valve of the bag of the present invention;

Figure 4:
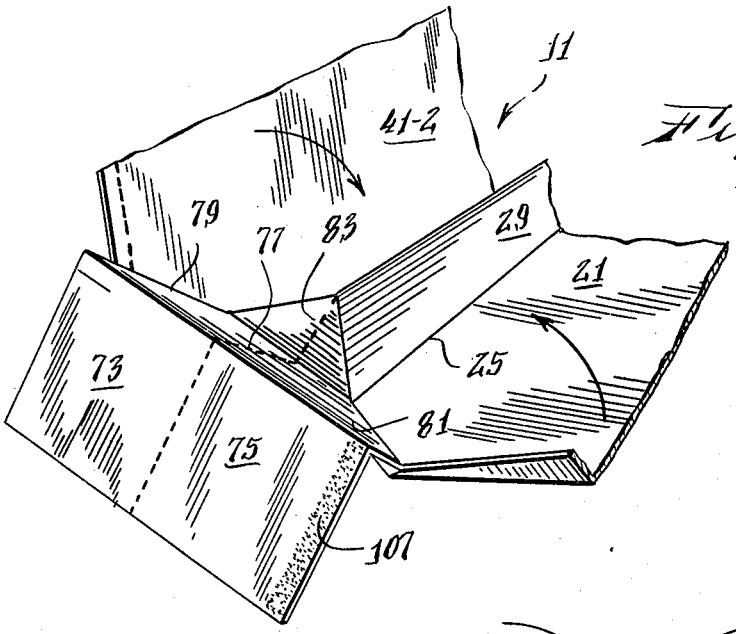

The present invention is directed to an improved multi-ply, gusseted, stepped end, pinch bottom bag of the type which includes a sleeved valve in a corner of one end for receiving a filling spout of a product dispensing machine. In the past, such bags have been constructed by taking a valve sleeve of the type employed in a standard sewn bag and then changing the cut shape of the pinch bottom bag blank in the region where the valve is formed to accommodate the valve sleeve. This approach has not proven to be entirely satisfactory. According to this invention, a pinch bottom valve bag is constructed by changing the shape of the valve sleeve blank to suit the shape of the bag blank. Two blanks are utilized in constructing the sleeved valve, pinch bottom bag of this invention; one for making the bag itself and the other for making the valve sleeve.

Referring now to FIG. 1, there is illustrated the upper end of the blank 11 for making the bag. Blank 11 is cut from a continuous web of flexible sheet material, such as the bag blank disclosed in U.S. Pat. No. 3,776,451. This blank includes a plurality of contiguous plies identified by reference numerals 13, 15, 17, and 19. The number of plies may be varied to suit the particular end use of the bag and some of the plies may be formed from specialty papers to give the bag unique properties such as water resistance and scuff resistance. The plies 13, 15, 17 and 19 are longitudinally stepped so that when blank 11 is formed into a tubular member the joining of the respective longitudinal edges of each ply will be staggered. As can be seen, blank 11 contains a back panel 21 that is foldably attached along longitudinal fold lines 23 and 25 to first gusset panels 27 and 29, respectively. First gusset panels 27 and 29 are foldably attached along longitudinal fold lines 31 and 33 to second gusset panels 35 and 37, respectively. Second gusset panels 35 and 37 are foldably attached along longitudinal fold lines 39 and 43 to one sections 41–1 and 41–2, respectively of front panel 41. Finally, blank 11 is provided with a lateral fold line 47 and a pair of diagonal fold lines 49 and 51 which are located at the top of the blank in the region of gussets 29 and 37 and which are used, as will hereinafter be described, in forming the valve portion of the bag. The valve area defined by fold lines 49 and 51 includes two triangular panel sections 53 and 55, two rectangular panel sections 57 and 59, and two triangular panel sections 61 and 63. Additionally, the outer ply 19 is slit as shown at 109 at a predetermined distance from fold line 25, while the inner plies 13, 15, and 17 are slit along a line 111 therebeneath, to form a reinforced corner for the valve sleeve, when the sleeve is joined to the bag, as described hereinafter.

As can be seen, gusset panels 29 and 37 are offset from one another to form steps and also offset from back panel 21 and front section 41–2 of front panel 42 to form steps. Similarly, gusset panels 27 and 35 are offset from each other and from back panel 21 and front section 41–2 of front panel 42. As can be appreciated, except for the number of plies shown, slits 109, 111, and fold lines 47, 49, and 51, blank 11 is identical to the blank used to form the multi-ply, gusseted stepped end pinch bottom bag in the aforementioned U.S. Pat. No. 3,776,451.

It is noted that only one end of blank 11 is shown; in FIG. 1 however, it is understood that the other end is simlar in construction, but of course does not include the lateral and diagonal valve forming fold lines since a valve is only formed into a tubular structure by longitudinally and reversibly creasing the blank along fold lines 31 and 33 and then adhesively attaching front section 41–1 to corresponding plies of front section 41–2. When blank 11 is further longitudinally creased along fold lines 23, 25, 39 and 43, a pair of oppositely disposed gussets indicated generally by reference numerals 65 and 67 are formed between the front and rear walls 21 and 41.

Referring now to FIG. 2, there is illustrated the blank for use in forming the valve sleeve 71. The blank is made of a single ply of flexible sheet material, such as kraft paper or the like, although more than one ply may be used for increased strength, if so desired. The blank includes a pair of rectangular panels 73 and 75 which are hingedly connected to each other by a lateral fold line 77 with one edge of panel 75 being coated with adhesive 107. The blank further includes a pair of five sided panels 79 and 81 which are hingedly connected to each other by a lateral fold line 83 and which together define a tuck-in flap that is in the shape of a trapezoid. Panels 79 and 81 are also hingedly connected to panels 73 and 75 respectively by a common fold line 85. Panels 79 and 81 taken together are sized and shaped to conform to the generally trapezoidally shaped pocket formed when panels 53, 55, 57 and 59 are folded in against the inside walls of the bag.

Figure 5:
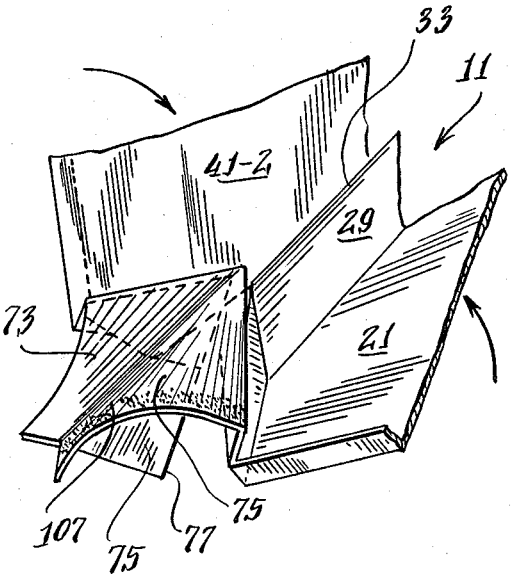
Figure 6:
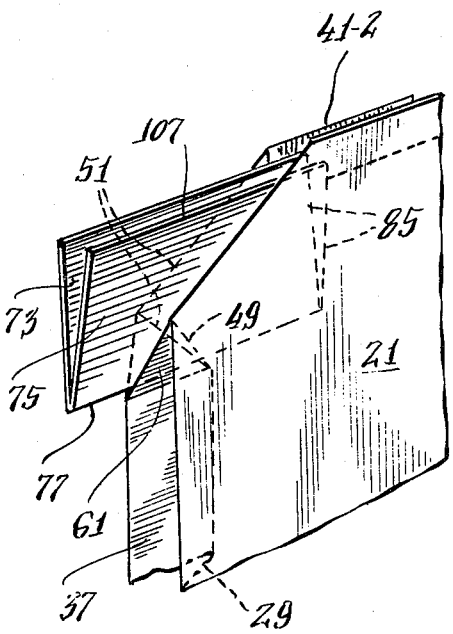
Figure 7:
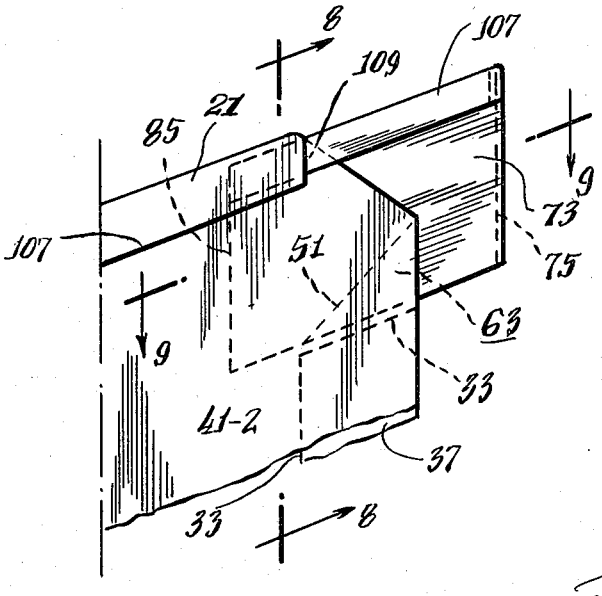
Figure 8:
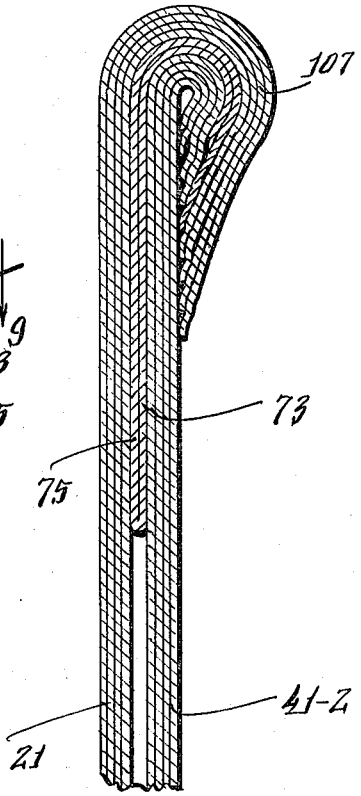
FIG. 8 is a section view taken along lines 8—8 in FIG. 7.
Figure 9:
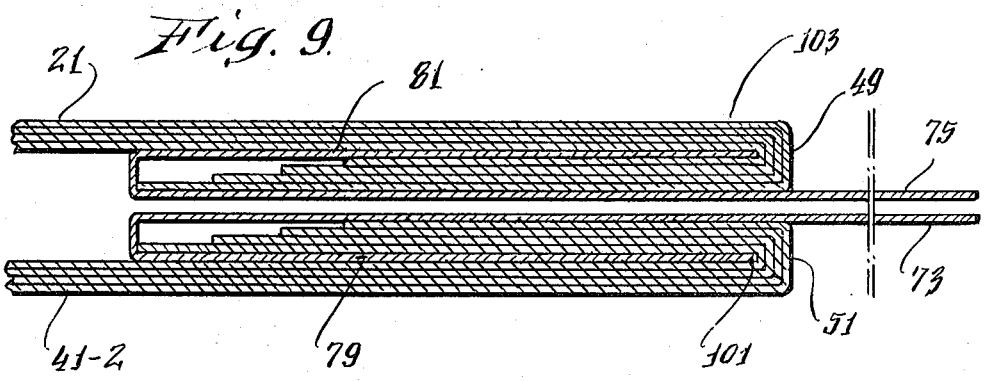
FIG. 9 is a section view taken along lines 9—9 in FIG. 7.
Figure 10:
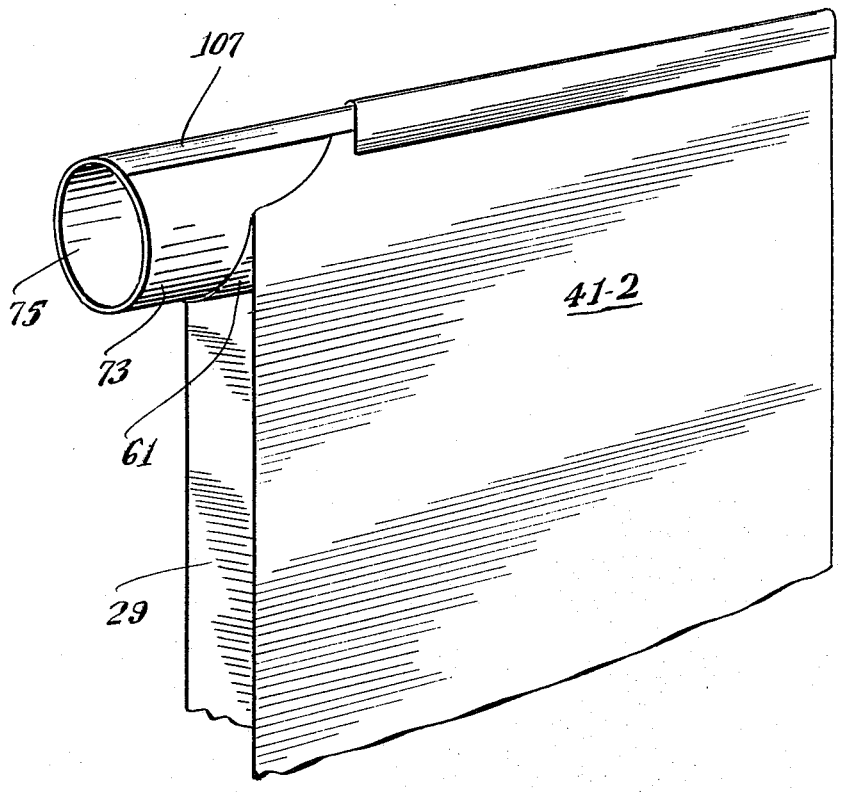
FIG. 10 is a perspective mirror image view of the sleeved valve corner of the bag of the present invention, completely assembled and ready for use.

Referring now to FIGS. 3 through 7, there is illustrated the sequence for forming the valve in the bag and attaching the valve sleeve to the valve area to form the sleeved valve bag of the present invention. As will be appreciated, the folding arrangement, for folding the various panels and panel sections of the bag blank to form a valve area is substantially the same as the folding arrangement in U.S. Pat. No. 4,069,964. The location of the valve sleeve in the valve area along with its shape and manner of attachment are, however, different. As shown in FIG. 3, the bag blank is spread open to a flattened condition in the valve region with edges 99, 101, 103, and 105 of blank 71 in exact registration with fold lines 47, 49, and 51 and pasted in place therein. Then, as shown in FIGS. 4 through 6, back panel 21 and front panel section 41–2 are folded up towards each other and panel sections 53, 55, 57 and 59 infolded so as to form a valve area. As can be seen, a portion of panels 79 and 81 is sandwiched between panels 59, 57, 61 and 63 and the remainder of panels 79 and 81 is sandwiched between panels 53, 55, and the inside walls of back panel 21 and front panel section 41–2 forming thereby a completely siftproof interconnection. Rectangular panels 73 and 75 of sleeve blank 71 are then folded back on fold line 85. Because of the step cuts in the top edges of the bag, the top edge of panel 21 overlaps the corresponding edge of panel 41–2. Further, blank 71 is precut so that the top edge of panel 75 overlaps panel 73. The top edges of panels 21 and 75 are then folded over and respectively adhesively secured to panels 41–2 and 73 to produce the completed valve corner, as shown in FIGS. 7 and 10. Because of slits 109 and 111, more of the rolled over edge of panel 21 covers the edge of panel 41–2 at the corner to reinforce the joinder of the valve sleeve and bag.

As can be appreciated, the bag can be assembled either by hand or by machine.

It is to be understood that various chnages in the details, materials and arrangements of parts which have been herein described and illustrated in order to explain the nature of the invention, may be made by those skilled in the art within the principle and scope of the invention as expressed in the appended claims.

The embodiments of the invention in which an exclusive property or privilege is claimed are defined as follows:

1. A gusseted stepped end pinch bottom valve bag having a multi-ply tubular body, said bag comprising:

an inner ply of flexible sheet material and an outer ply of flexible sheet material;

a front wall formed from said plies and having a terminal edge;

a rear wall formed from said plies and having a terminal edge at which said inner and outer plies are in stepped relation to one another;

a pair of first gusset panels formed from said plies and foldably connected to said front wall along a first pair of longitudinal fold lines;

a pair of second gusset panels formed from said plies and foldably connected to said first panels along a second pair of longitudinal fold lines and to said rear wall along a third pair of longitudinal fold lines;

a valve opening formed from an infolded portion of said bag at a corner thereof adjacent said terminal edges, said infolded portion including portions of the inner and outer plies of said front and rear walls;

a valve sleeve sandwiched within said infolded portion, said valve sleeve comprising front and rear rectangular panels, said rear panel being adjacent an infolded portion of the outer ply of said rear wall and said front panel being adjacent an infolded portion of the outer ply of said front wall, said rear panel having a lip portion extending beyond an edge of said front panel and the adjacent terminal edge of said front wall, said lip portion being folded over said front panel and front wall edges and secured to said front panel and front wall by adhesive means;

said stepped terminal edge of said rear wall extending beyond the terminal edge of said front wall and being, folded-over said lip portion and said front wall and secured to said front wall by adhesive means; and a slit in the outer ply of said rear wall, said slit separating the infolded portion of said rear wall outer ply, which is part of said valve opening, from the portion of said rear wall outer ply which is part of the folded-over rear wall terminal edge.

2. The bag of claim 1 and wherein the portion of said sleeve sandwiched within said infolded area of said bag is sized and shaped to correspond generally to the shape of the infolded area of the bag.

3. The bag of claim 2 and wherein said infolded area is generally trapezoidally shaped.

4. The bag of claim 1 wherein the inner and outer plies forming said front wall are in stepped relation to each other at the terminal edge of said front wall.

* * * * *